US009106034B2

(12) United States Patent
Tsai et al.

(10) Patent No.: US 9,106,034 B2
(45) Date of Patent: Aug. 11, 2015

(54) COAXIAL CONNECTOR

(71) Applicant: LOTES CO., LTD, Keelung (TW)

(72) Inventors: Shang Ju Tsai, Keelung (TW); Yan Xian Yuan, Keelung (TW); Hua Hui Zhi, Keelung (TW); Chun Yu Peng, Keelung (TW)

(73) Assignee: LOTES CO., LTD, Keelung (TW)

( * ) Notice: Subject to any disclaimer, the term of this patent is extended or adjusted under 35 U.S.C. 154(b) by 12 days.

(21) Appl. No.: 14/149,438

(22) Filed: Jan. 7, 2014

(65) Prior Publication Data

US 2015/0072544 A1 Mar. 12, 2015

(30) Foreign Application Priority Data

Sep. 11, 2013 (CN) ..... 2013 2 0564114 U

(51) Int. Cl.
*H01R 24/50* (2011.01)
*H01R 24/46* (2011.01)

(52) U.S. Cl.
CPC ..... *H01R 24/50* (2013.01); *H01R 24/46* (2013.01)

(58) Field of Classification Search
CPC ... H01R 24/50; H01R 9/0515; H01R 23/7073
USPC ..... 439/63
See application file for complete search history.

(56) References Cited

U.S. PATENT DOCUMENTS

2010/0130028 A1 * 5/2010 Hoshiba et al. ..... 439/63
2011/0159708 A1 * 6/2011 Huang et al. ..... 439/63

* cited by examiner

*Primary Examiner* — Abdullah Riyami
*Assistant Examiner* — Nelson R Burgos-Guntin
(74) *Attorney, Agent, or Firm* — Locke Lord LLP; Tim Tingkang Xia, Esq.

(57) ABSTRACT

A coaxial connector for a mating device to be inserted therein, includes an insulating body having a sustaining portion, a static terminal having a first contact portion, and a movable terminal having a second contact portion for contacting the first contact portion. The sustaining portion and an object below have a gap therebetween. The static terminal and the movable terminal are fixed to the insulating body. An elastic arm is formed by extending from the second contact portion. The sustaining portion engages the elastic arm. When the mating device is inserted into the coaxial connector, the mating device presses the elastic arm downwards, the second contact portion moves downwards to be separated from the first contact portion, and the elastic arm drives the sustaining portion to move downwards together, such that the sustaining portion butts against the object below to prevent the movable terminal from moving downwards excessively.

19 Claims, 9 Drawing Sheets

COAXIAL CONNECTOR

CROSS-REFERENCE TO RELATED APPLICATION

This non-provisional application claims priority under 35 U.S.C. §119(a) on Patent Application No. 201320564114.X filed in P.R. China on Sep. 11, 2013, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to a coaxial connector, and more particularly to a coaxial connector having a switch structure.

BACKGROUND OF THE INVENTION

Chinese patent with Application No. 201110146250.2 discloses a coaxial connector, including a second case, a fixed terminal and a movable terminal. The fixed terminal and the movable terminal are embedded into the second case through an insert molding process. The fixed terminal and the movable terminal are lapped and respectively embedded in two opposite side faces of the second case, and have substantially the same upper and lower positions. The movable terminal includes a base portion, an elastic arm portion formed by folding upwards from a middle portion of a side edge of the base portion, a contact portion formed by extension of the end of the elastic arm portion, and a fixing portion extending from another side edge of the base portion. The second case has a bridging portion corresponding to the fixing portion. When a test probe inserts the coaxial connector, the test probe presses the elastic arm downwards, the contact portion moves toward a direction away from the fixed terminal and disconnects from the fixed terminal. Meanwhile, the elastic arm moves downwards under the action of the pushing force of the test probe, with the elastic arm butting against the fixing portion and the fixing portion butting against the bridging portion, the movable terminal is blocked to be unable to continuously move, so as to avoid that plastic deformation occurs in the elastic arm of the movable terminal due to excessive downward movement of the movable terminal. However, as the movable terminal needs to be separately provided with a structure, that is, the fixing portion, to prevent excessive downward movement of the movable terminal, thus the structure of the movable terminal is complex. Further, the movable terminal has a large sheet punching area, which wastes materials.

Therefore, a heretofore unaddressed need exists in the art to address the aforementioned deficiencies and inadequacies.

SUMMARY OF THE INVENTION

In one aspect, the present invention is directed to a coaxial connector that prevents excessive downward movement of the movable terminal and has a simple terminal structure.

In one embodiment, a coaxial connector provided for a mating device to be inserted downwards therein. The coaxial connector includes an insulating body, a static terminal and a movable terminal. The insulating body has a sustaining portion. The sustaining portion and an object below have a gap therebetween. The static terminal and the movable terminal are fixed to the insulating body. The static terminal has a first contact portion. The movable terminal has a second contact portion used for contacting the first contact portion. An elastic arm is formed by extending from the second contact portion. The sustaining portion engages the elastic arm. When the mating device is inserted into the coaxial connector, the mating device presses the elastic arm downwards, the second contact portion moves downwards to be separated from the first contact portion. At the same time, the elastic arm drives the sustaining portion to move downwards together. Through the butting of the sustaining portion against the object below, the movable terminal is prevented from moving downwards excessively.

Further, the object below is a circuit board.

Further, the sustaining portion includes a base portion located below the elastic arm and a convex portion formed by extending from the base portion upwardly, and the elastic arm is provided with a hole to engage the convex portion.

Further, the base portion includes an elastic portion connected with the insulating body and an extending portion extending from the elastic portion, and a thickness of the elastic portion is thinner than that of the extending portion.

Further, a width of the elastic portion is narrower than that of the extending portion.

Further, the extending portion has a first lower surface connected with the elastic portion, and a second lower surface connected with the first lower surface. A distance from the second lower surface to the object below gradually increases along a direction close to the static terminal.

Further, the second lower surface is a slope, and when the sustaining portion butts against the object below, the second lower surface presents as a horizontal plane to butt against the object below.

Further, a distance from the first lower surface to the object below gradually increases along a direction away from the static terminal.

Further, the first lower surface is a slope.

Further, when the mating device presses the elastic arm downwards, an axial centerline of the mating device passes through the sustaining portion.

Further, before the coaxial connector is welded to a circuit board, the second contact portion is located above the first contact portion.

Further, before the coaxial connector is welded to the circuit board, the second contact portion is lapped on the first contact portion.

Further, the first contact portion has a first guiding surface on one side, and the second contact portion is lapped on the first guiding surface, so that the first guiding surface guides the second contact portion to move downwards.

Further, the second contact portion is provided with a second guiding surface coinciding with the first guiding surface, and the second guiding surface is lapped on the first guiding surface.

Further, a top surface of the second contact portion is lower than that of the first contact portion.

Further, the insulating body is provided with at least one stopping portion located above the second contact portion, and the stopping portion stops the second contact portion from moving upwards.

Further, the insulating body is provided with a fixing portion to fix the static terminal. A support portion is formed by extending from one side of the fixing portion. The first contact portion is lapped on the support portion.

Further, after the mating device leaves the movable terminal, the second contact portion butts against the first contact portion upwards.

Further, the static terminal and the movable terminal both are embedded into the insulating body through an insert molding process.

Compared with the related art, in certain embodiments of the present invention, as the elastic arm of the movable terminal drives the sustaining portion to move downwards together, to prevent the movable terminal from excessively moving downwards with the sustaining portion butting against the object below, the movable terminal does not need to be additionally provided with a structure to prevent the movable terminal from excessively moving downwards, so that the movable terminal has a simple structure.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
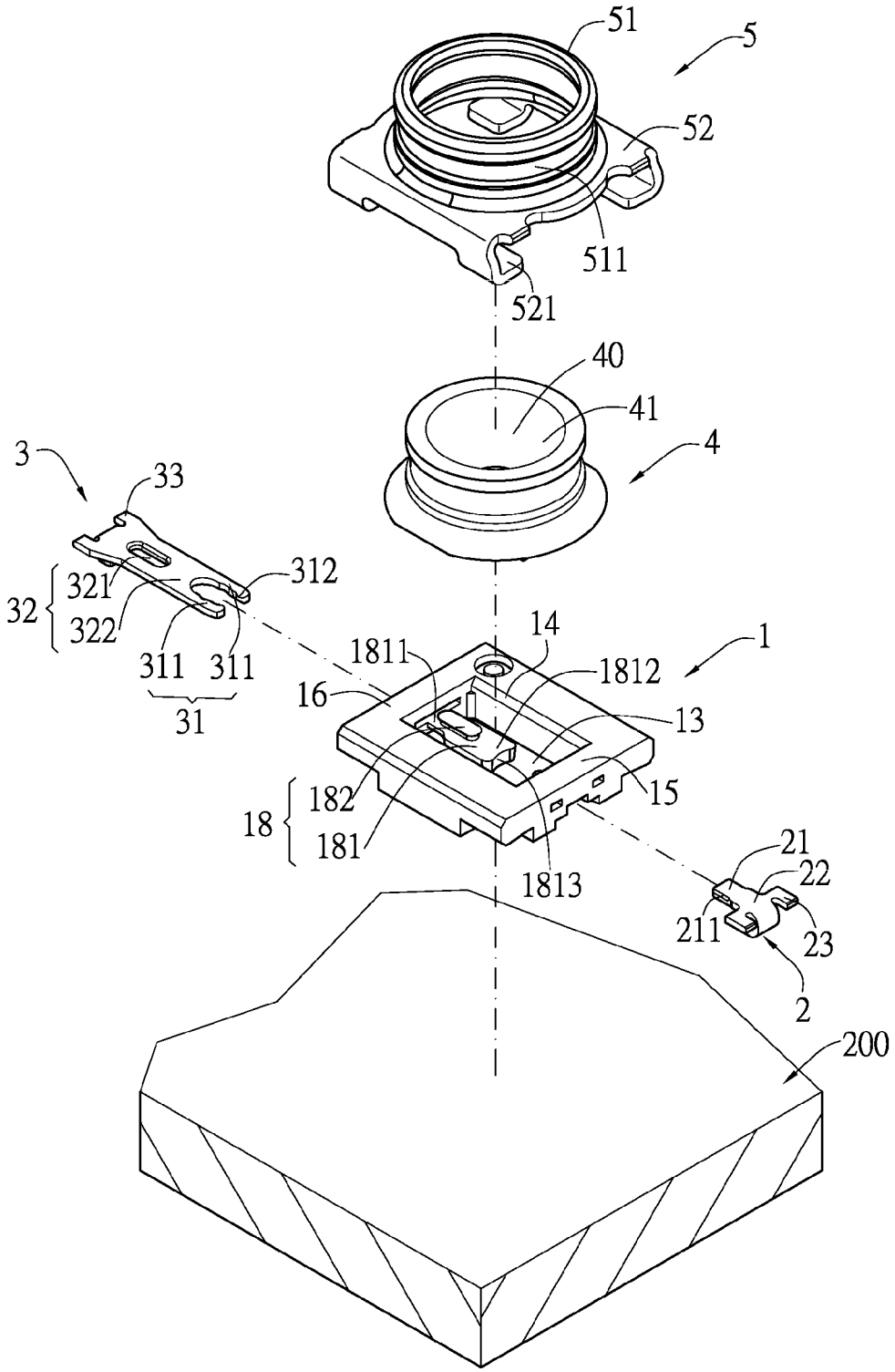
FIG. 1 is a schematic exploded view of a coaxial connector and a circuit board according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 6:
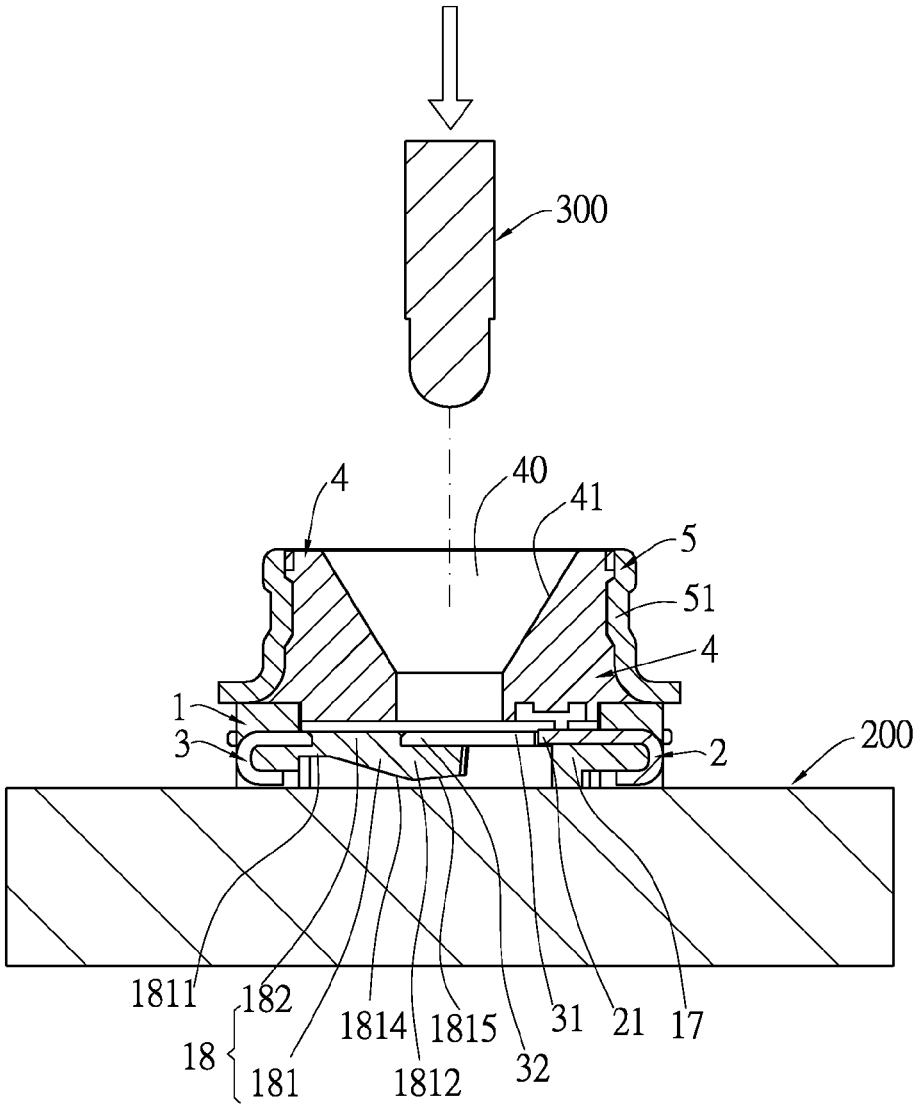
FIG. 6 is a planar cutaway view before a mating device is inserted into the coaxial connector according to one embodiment of the present invention.

Referring to FIG. 1 and FIG. 6, a coaxial connector according to one embodiment of the present invention is used to be welded onto a circuit board 200, and available for a mating device (not shown in the figure) having a pin 300 to be inserted downwards. The coaxial connector includes an insulating body, a static terminal 2, a movable terminal 3, and a case 5. The insulating body includes a lower insulating seat 1 and an upper insulating seat 4 mounted on the lower insulating seat 1. The static terminal 2 and the movable terminal 3 achieve a switching function, and are fixed in the lower insulating seat 1. The case 5 wraps the upper insulating seat 4 and the lower insulating seat 1.

Figure 2:
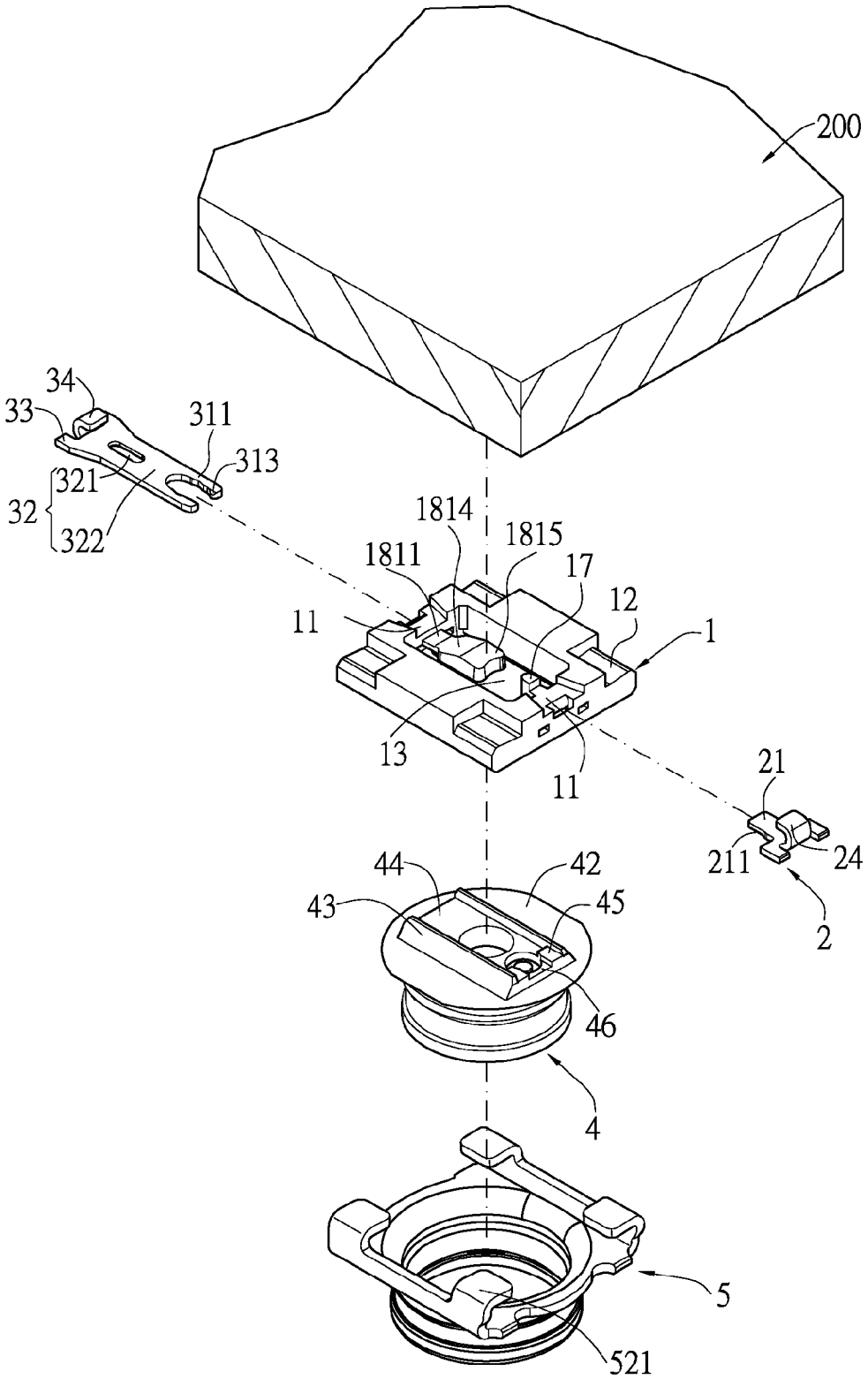
FIG. 2 is a schematic exploded view of inversion of the coaxial connector in FIG. 1.
Figure 3:
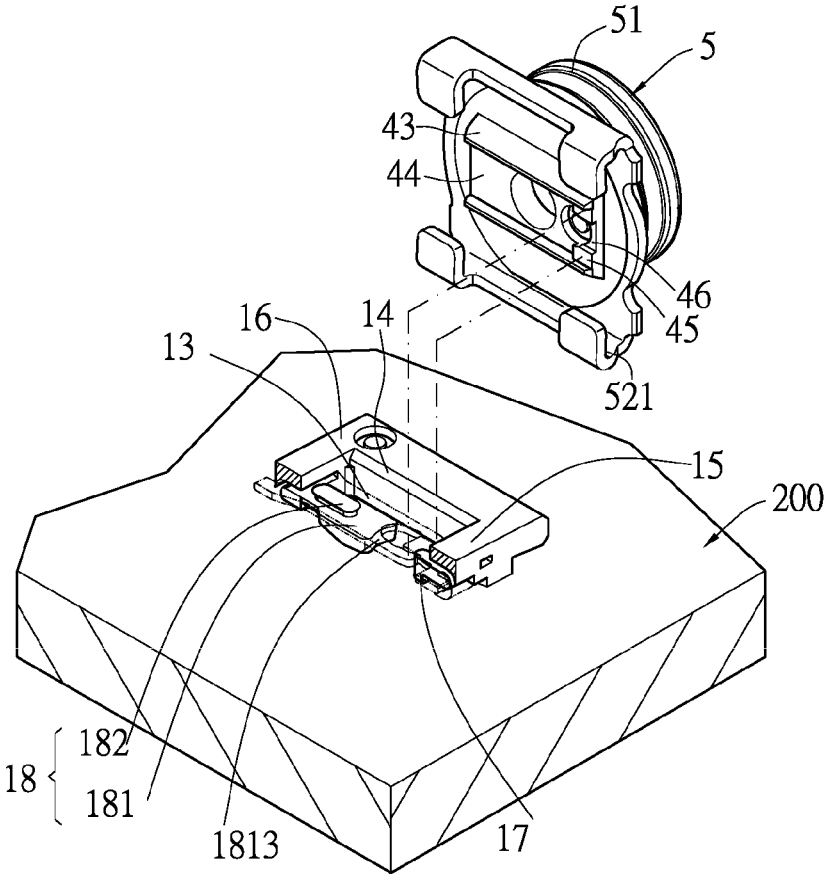
FIG. 3 is a three-dimensional cutaway view of a coaxial connector not mounted with a static terminal and a movable terminal according to one embodiment of the present invention.

Referring to FIG. 1 and FIG. 2, the lower insulating seat 1 takes on a substantially tetragonal structure, the lower insulating seat 1 is centrally provided with a receiving space 13 throughout the top and the bottom of the lower insulating seat 1. The receiving space 13 has four sidewalls. To facilitate smooth assembling of the upper insulating seat 4 onto the lower insulating seat 1, upper ends of two opposite sidewalls are made into an inclined surface 14 inclined toward the receiving space 13 (that is to say, an inner diameter of the receiving space 13 gradually becomes smaller from top to bottom), used to guide the upper insulating seat 4. A first fixing portion 15 and a second fixing portion 16 are formed by extending from the other two opposite sidewalls. A support portion 17 is formed by extending from one side of the first fixing portion 15 to be located in the receiving space 13, and a sustaining portion 18 is formed by extending from one side of the second fixing portion 16 to be located in the receiving space 13.

Referring to FIGS. 1, 2 and 6, the sustaining portion 18 includes a base portion 181 and a convex portion 182 formed by extending from the base portion 181 upwardly. The size of the base portion 181 is greater than that of the convex portion 182. The base portion 181 includes an elastic portion 1811 connected with the insulating body and an extending portion 1812 formed by extending from the elastic portion 1811. A thickness of the elastic portion 1811 is thinner than that of the extending portion 1812, and a width of the elastic portion 1811 is narrower than that of the extending portion 1812, so as to ensure that the elastic portion 1811 has good resilience. One end, away from the elastic portion 1811, of the extending portion 1812 is provided with a notch 1813 recessed towards a direction close to the elastic portion 1811. The extending portion 1812 has a first lower surface 1814 connected with the elastic portion 1811, and a second lower surface 1815 connected with the first lower surface 1814. The second lower surface 1815 and the object below have a gap therebetween, and a distance from the second lower surface 1815 to the object below gradually increases along a direction close to the support portion 17. The second lower surface 1815 is a slope. When the sustaining portion 18 butts against the object below, the second lower surface 1815 presents as a horizontal plane to butt against the object below. In this embodiment, the object below is a circuit board 200 (alternatively, in other embodiments, the object below also may be a bottom wall of the lower insulating seat 1 or the like). The first lower surface 1814 is also a slope, and a distance from the first lower surface 1814 to the object below (that is, the circuit board 200) gradually increases along a direction away from the support portion 17.

Referring to FIG. 2, two opposite sides at the bottom of the lower insulating seat 1 are respectively provided with a receiving slot 11. Each of the receiving slots 11 locates on one side of the receiving space 13 and communicates with the receiving space 13. The receiving slot 11 is trapezoidal and is narrow inside and wide outside. Each of the four corners of the lower surface 12 is respectively recessed with a retaining groove 12.

Referring to FIG. 1 and FIG. 2, the static terminal 2 has a first contact portion 21. Each of the two opposite sides of the static terminal 2 has a first guiding surface 211. In this embodiment, the first guiding surface 211 is a slope, and the slope and the top surface of the first contact portion 21 form an obtuse angle. That is to say, the thickness of the first contact portion 21 gradually becomes thinner towards its edge direction. A connecting portion 22 is formed by horizontally extending from the first contact portion 21. A first strip-connecting portion 23 is formed by horizontally extending from two opposite sides of the connecting portion 22 toward a direction away from the first contact portion 21. A first welding portion 24 is formed by bending downwards from the connecting portion 22 and horizontally extending toward a direction close to the first contact portion 21.

Referring to FIG. 1 and FIG. 2, the movable terminal 3 has a second contact portion 31. An elastic arm 32 is formed by horizontally extending from the second contact portion 31. A second strip-connecting portion 33 is formed by horizontally extending from two opposite sides of the elastic arm 32 toward a direction away from the second contact portion 31. A second welding portion 34 is formed by bending downwards from the elastic arm 32 and horizontally extending toward a direction close to the second contact portion 31.

Figure 5:
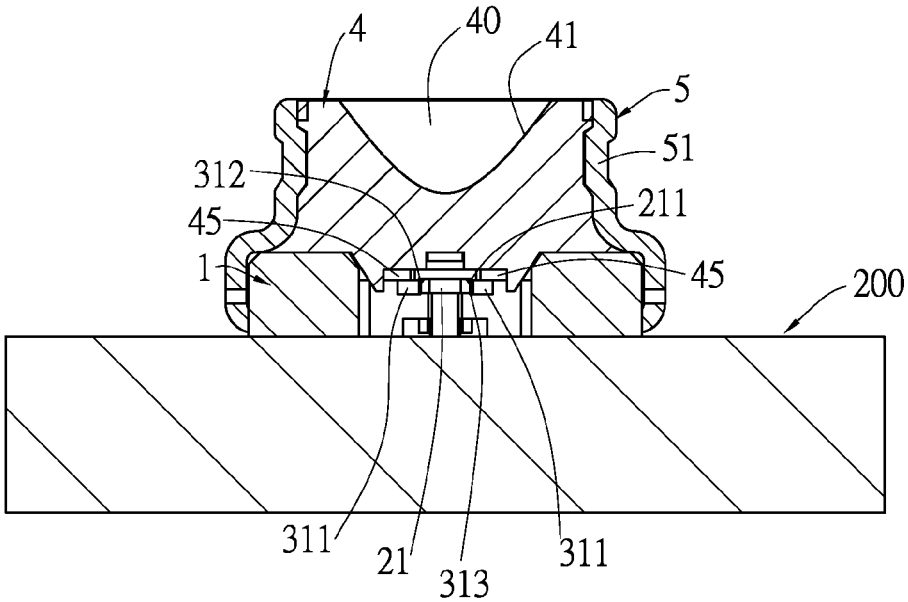
FIG. 5 is a planar cutaway view of a coaxial connector according to one embodiment of the present invention.

Referring to FIG. 1 and FIG. 5, the second contact portion 31 is forked to form two branches 311. The end of each branch 311 is convexly provided with a protrusion 312 toward the first guiding surface 211, and the bottom of the protrusion 312 has a second guiding surface 313 coinciding with the first guiding surface 211 (that is, the second guiding surface 313 is parallel to the first guiding surface 211).

Figure 4:
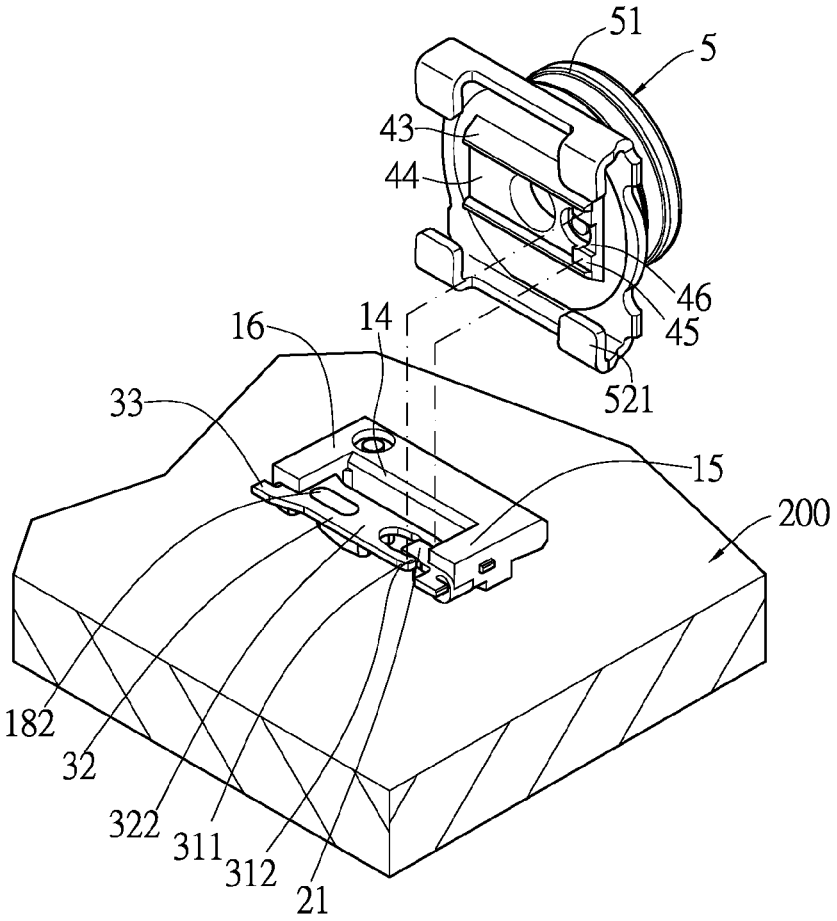
FIG. 4 is a three-dimensional cutaway view of a coaxial connector after being mounted with the static terminal and the movable terminal according to one embodiment of the present invention.

Referring to FIG. 1 and FIG. 4, the elastic arm 32 is provided with a hole 321, used to engage the convex portion 182. The elastic arm 32 is provided with a pressed portion 322 between the hole 321 and the forked position, for the pin 300 of the mating device to be pressed downwards.

Referring to FIGS. 1, 2 and 6, the upper insulating seat 4 is substantially columnar. The upper insulating seat 4 is centrally opened with a mating cavity 40 for the pin 300 of the mating device to be inserted therein. An inner wall 41 of the mating cavity 40 takes on an inverted cone shape (that is to say, the size of the mating cavity 40 gradually becomes smaller from top to bottom), used to guide insertion of the pin 300. The upper insulating seat 4 has a lower wall surface 42, used to be lapped on the top of the lower insulating seat 1. The lower wall surface 42 is convexly provided with two positioning blocks 43 downwards. Out sides of the positioning blocks 43 are inclined, to coincide with the inclined surface 14. Upward recessing between the two positioning blocks 43 forms a recessed portion 44, communicating with the mating cavity 40. The size of the recessed portion 44 is greater than that of the movable terminal 3 and that of the static terminal 2. Extension from the two positioning blocks 43 forms two opposite stopping portions 45, corresponding to two branches 311 of the movable terminal 3. A gap between the two stopping portions 45 forms a limiting slot 46 to communicate with the recessed portion 44. The limiting slot 46 is located directly above the first contact portion 21 of the static terminal 2, used to make way for the first contact portion 21, to avoid that the stopping portions 45 touch the first contact portion 21.

Referring to FIG. 1 and FIG. 2, the case 5 is formed through stamping of metal materials, and has a grounding function. The case 5 includes a sleeve portion 51 and a baseboard portion 52 disposed in an up and down manner. The sleeve portion 51 and the baseboard portion 52 smoothly transit to join up and down. The sleeve portion 51 is externally provided with a clamping portion 511 for the mating device to snap into. In this embodiment, the clamping portion 511 is an annular groove disposed on a periphery of the sleeve portion 51. The baseboard portion 52 has four ground pins 521 bending inwards and extending horizontally.

Referring to FIGS. 1, 5 and 6, in assembling, firstly, the static terminal 2 and the movable terminal 3 are oppositely disposed, and the static terminal 2 and the movable terminal 3 both are fixed in the lower insulating seat 1 by means of insert molding). Then, the first contact portion 21 is lapped on the support portion 17, the connecting portion 22 is fixed to the first fixing portion 15, the end of the first strip-connecting portion 23 is exposed out of the lower insulating seat 1, and the first welding portion 24 enters the receiving slot 11. The two branches 311 of the second contact portion 31 clamp the first contact portion 21, the second guiding surface 313 is lapped on the first guiding surface 211 so that a top surface of the second contact portion 31 is lower than that of the first contact portion 21, the elastic arm 32 is located above the base portion 181 of the sustaining portion 18, the hole 321 engages the convex portion 182, the end of the second strip-connecting portion 33 is exposed out of the lower insulating seat 1, and the second welding portion 34 enters the receiving slot 11.

Secondly, the lower insulating seat 4 is fixed in the sleeve portion 51 of the case 5 by means of insert molding.

Next, the lower insulating seat 4 and the case 5 are together mounted and fixed to the lower insulating seat 1. So, the mating cavity 40 communicates with the receiving space 13, the positioning blocks 43, corresponding to the two inclined surfaces 14, are loaded in the receiving space 13, the stopping portion 45 is located above the branch 311 of the second contact portion 31 and the stopping portion 45 butts against the end of the branch 311, the baseboard portion 52 wraps the lower insulating seat 1, the ground pins 512 enter the retaining groove 12, and thus the ground pins 512 can play a role of clamping the upper insulating seat 4 and the lower insulating seat 1, so that they are combined more closely and reliably.

Referring to FIG. 1 and FIG. 6, then, the assembled coaxial connector is put into a high-temperature furnace, to weld the first welding portion 24 and the second welding portion 34 to the circuit board 200, so that the coaxial connector is welded onto the circuit board 200, and in the meantime, the support portion 17 butts against the circuit board 200. In this process, the temperature in the furnace is very high, the lower insulating seat 1 is easily softened by heat. Before the coaxial connector is welded to the circuit board 200 (not shown in the figure), and further, before the mating device is inserted to the coaxial connector for the first time, the second contact portion 31 is located above the first contact portion 21. In this embodiment, the second contact portion 31 is lapped on the first contact portion 21 (in other embodiments, the second contact portion 31 may be suspended above the first contact portion 21). Specifically, the second guiding surface 313 is lapped on the first guiding surface 211, which prevents the movable terminal 3 from inclining downwards or getting down due to plastic softening, and thus prevents the movable terminal 3 from imperfectly contacting the static terminal 2 due to insufficient butting normal force.

Figure 7:
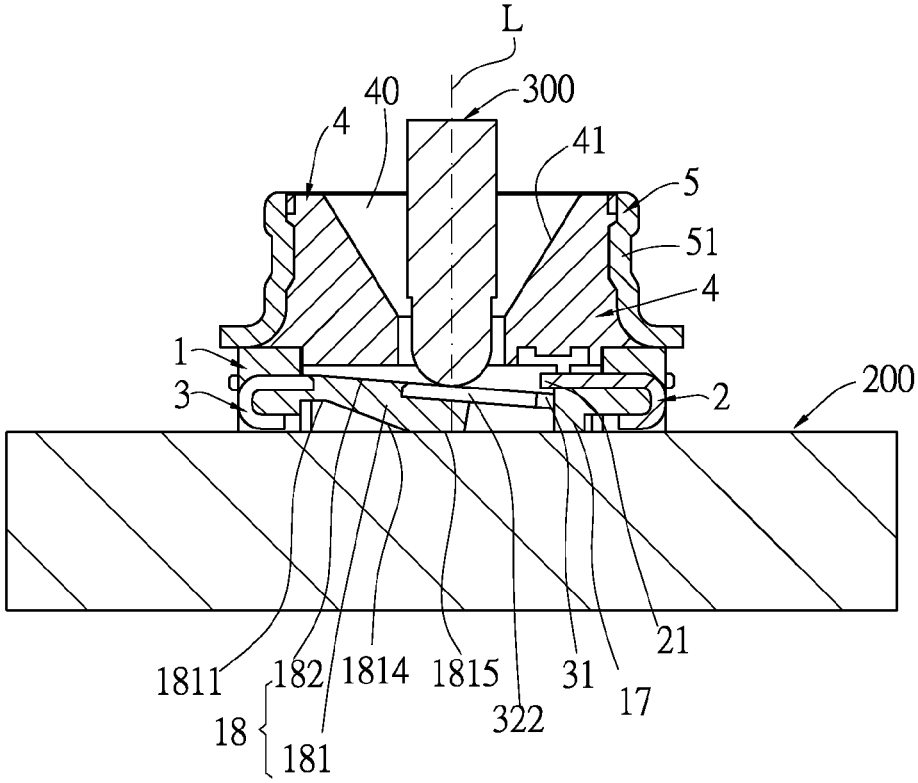
FIG. 7 is a planar cutaway view after the mating device is inserted into the coaxial connector according to one embodiment of the present invention.

Referring to FIG. 6 and FIG. 7, after the coaxial connector is welded to the circuit board 200, and when the mating device is inserted downwards to the coaxial connector for the first time, the pin 300 passes through the mating cavity 40 to enter the receiving space 13 until it presses the pressed portion 322 downwards (at this time, an axial centerline L of the pin 300 passes through the sustaining portion 18). The pressed portion 322 moves downwards subjecting to the pressing force of the pin 300 and drives the sustaining portion 18 to move downwards, and meanwhile, the second contact portion 31 is elastically deformed downwards and moves downwards, and crosses the first contact portion 21 with the guide of the first guiding surface 211, so that the second contact portion 31 is located below the first contact portion 21, and the second contact portion 31 is detached from the first contact portion 21.

After the second contact portion 31 moves downwards to be detached from the first contact portion 21, the sustaining portion 18 can stop the movable terminal 3 from excessively moving downwards. Specifically, as the elastic portion 1811 provides resilience, the sustaining portion 18 can move downwards with the second contact portion 31. A junction between the first lower surface 1814 and the second lower surface 1815 first contacts the circuit board 200 and has a stopping effect on it. With the continuous downward movement of the second contact portion 31, the second lower surface 1815 contacts the circuit board 200 sequentially from left to right (according to the direction in FIG. 6), until the second lower surface 1815 presents as a horizontal plane to butt against the circuit board 200. The sustaining portion 18 cannot move downwards any more, and then due to the stopping effect of the sustaining portion 18, the movable terminal 3 can no longer move downwards.

Figure 8:
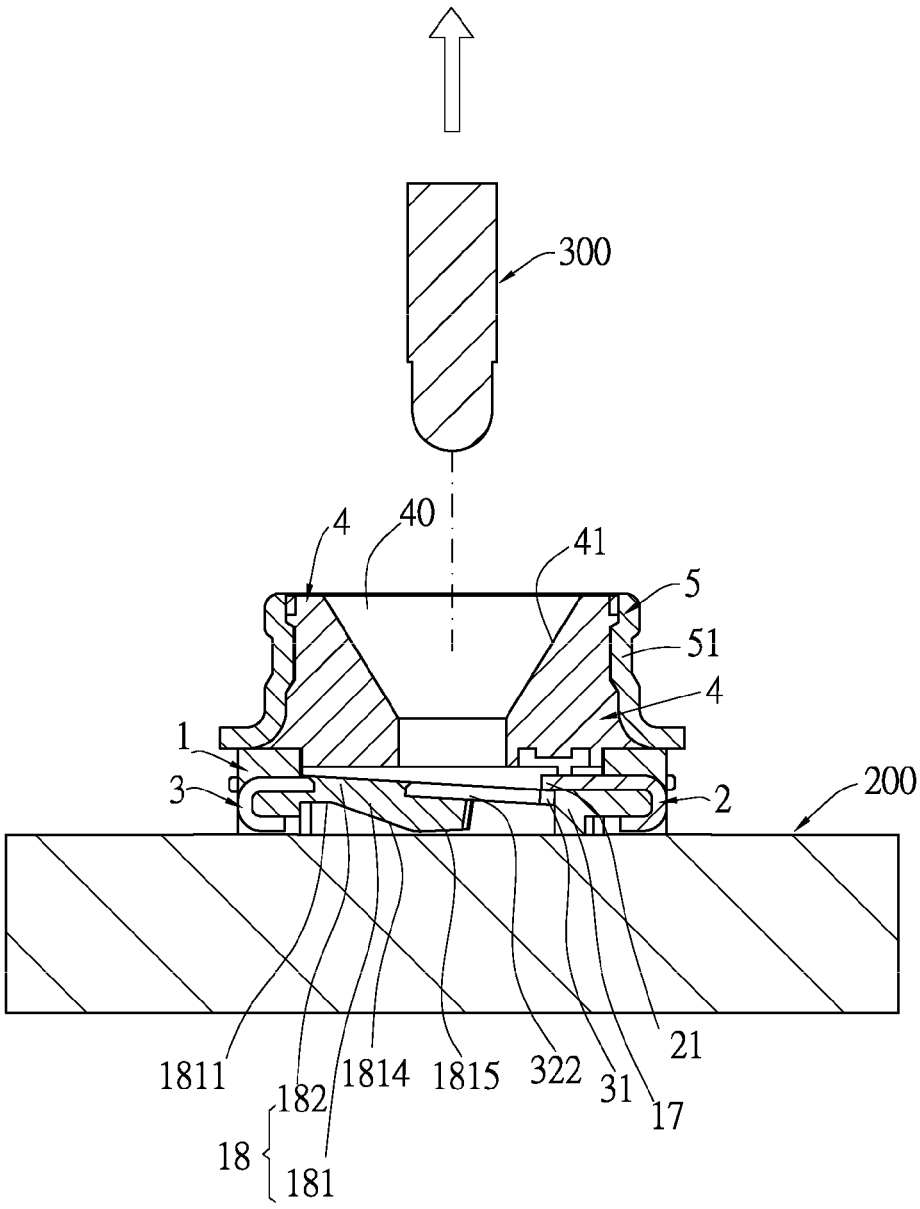
FIG. 8 is a planar cutaway view after the mating device leaves the coaxial connector according to one embodiment of the present invention.
Figure 9:
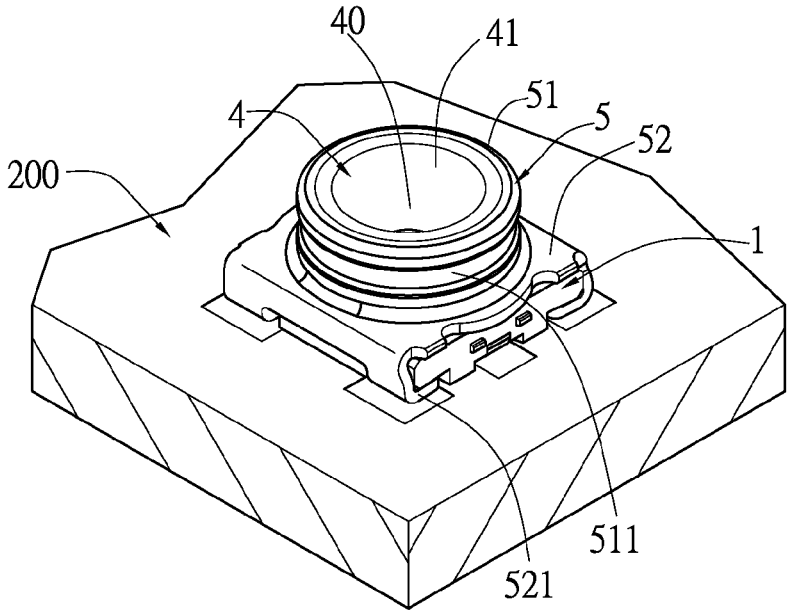
FIG. 9 is a combined view showing the coaxial connector according to one embodiment of the present invention being welded to the circuit board.

Referring to FIG. 8, afterwards, when the pin 300 is pulled upwardly out of the coaxial connector (that is, after the mating device leaves the coaxial connector), the second contact portion 31 is elastically restored upwards due to not being pressed with external forces, the sustaining portion 18 is also elastically restored as the elastic portion 1811 provided resilience, and the second contact portion 31 butts upwardly against the first contact portion 21 (that is to say, the top surface of the second contact portion 31 butts against the bottom of the first contact portion 21).

Referring to FIG. 7 and FIG. 8, then, each time the mating device is inserted to the coaxial connector, the second contact portion 31 is detached from the first contact portion 21 to form an open circuit. Each time the mating device leaves the coaxial connector, the second contact portion 31 butts upwardly against the first contact portion 21, so that prestress is formed between the static terminal 2 and the movable terminal 3, which provides the normal force for the first contact portion 21 to butt against the second contact portion 31, and further, provides the normal force for the second contact portion 31 to butt upwardly against the first contact portion 21, so that, when the coaxial connector operates, electrical connection between the first contact portion 21 and the second contact portion 31 could be maintained by means of the normal force, thereby making the static terminal 2 and the movable terminal 3 maintain electrical conduction.

The present invention, among other things, has the following beneficial advantages.

1. As the first contact portion 21 of the static terminal 2 has a first guiding surface 211 on one side, which could guide the second contact portion 31 of the movable terminal 3 to move downwards, it can be achieved that the second contact portion 31 is moved below the first contact portion 21 to be detached from the first contact portion 21. That is, the movable terminal 3 and the static terminal 2 can be detached from each other smoothly, thereby ensuring a good switching function.

2. As the insulating body is provided with the support portion 17 and the first contact portion 21 of the static terminal 2 is lapped on the support portion 17, the support portion 17 supports the first contact portion 21, to prevent the static terminal 2 from being deformed downwards.

3. As the static terminal 2 and the movable terminal 3 are fixed into the insulating body by using an insert molding process, it facilitates the movable terminal 3 and the static terminal 2 to be mounted in the insulating body, and the structure is easy to manufacture and has dimensional stability, thereby improving product quality and production efficiency.

4. As the elastic arm 32 of the movable terminal 3 drives the sustaining portion 18 to move downwards together, to prevent the movable terminal 3 from excessively moving downwards with the sustaining portion 18 butting against the object below (in this embodiment, the object below is the circuit board 200, and it may be others in other embodiments), the movable terminal 3 does not need to be additionally provided with a structure to prevent the movable terminal 3 from excessively moving downwards, so that the movable terminal 3 has a simple structure.

5. As the insulating body is provided with the stopping portion 45 to be pressed above the second contact portion 31, and the stopping portion 45 stops the second contact portion 31 from moving upwards, the second contact portion 31 could be prevented from rising upwards, thereby ensuring good contact between the movable terminal 3 and the static terminal 2.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A coaxial connector for a mating device to be inserted therein, comprising:

an insulating body having a sustaining portion, wherein the sustaining portion and an object below have a gap therebetween;

a static terminal fixed to the insulating body, and having a first contact portion; and a movable terminal fixed to the insulating body, and having a second contact portion for contacting the first contact portion, wherein an elastic arm is formed by extending from the second contact portion, wherein the sustaining portion engages the elastic arm; and wherein when the mating device is inserted into the coaxial connector, the mating device presses the elastic arm downwards, the second contact portion moves downwards to be separated from the first contact portion, and the elastic arm drives the sustaining portion to move downwards together, such that the sustaining portion butts against the object below to prevent the movable terminal from moving downwards excessively.

2. The coaxial connector according to claim 1, wherein the object below is a circuit board.

3. The coaxial connector according to claim 1, wherein the sustaining portion comprises a base portion located below the elastic arm and a convex portion formed by extending from the base portion upwardly, and the elastic arm has a hole for engaging the convex portion.

4. The coaxial connector according to claim 3, wherein the base portion comprises an elastic portion connected with the insulating body and an extending portion extending from the elastic portion, and a thickness of the elastic portion is thinner than a thickness of the extending portion.

5. The coaxial connector according to claim 4, wherein a width of the elastic portion is narrower than a width of the extending portion.

6. The coaxial connector according to claim 4, wherein the extending portion has a first lower surface connected with the elastic portion, and a second lower surface connected with the first lower surface, and a distance from the second lower surface to the object below gradually increases along a direction close to the static terminal.

7. The coaxial connector according to claim 6, wherein the second lower surface is a slope, and when the sustaining portion butts against the object below, the second lower surface presents as a horizontal plane to butt against the object below.

8. The coaxial connector according to claim 6, wherein a distance from the first lower surface to the object below gradually increases along a direction away from the static terminal.

9. The coaxial connector according to claim 8, wherein the first lower surface is a slope.

10. The coaxial connector according to claim 1, wherein when the mating device presses the elastic arm downwards, an axial centerline of the mating device passes through the sustaining portion.

11. The coaxial connector according to claim 1, wherein before the coaxial connector is welded to a circuit board, the second contact portion is located above the first contact portion.

12. The coaxial connector according to claim 11, wherein before the coaxial connector is welded to the circuit board, the second contact portion is lapped on the first contact portion.

13. The coaxial connector according to claim 12, wherein the first contact portion has a first guiding surface on one side, and the second contact portion is lapped on the first guiding surface, so that the first guiding surface guides the second contact portion to move downwards.

14. The coaxial connector according to claim 13, wherein the second contact portion is provided with a second guiding surface coinciding with the first guiding surface, and the second guiding surface is lapped on the first guiding surface.

15. The coaxial connector according to claim 13, wherein a top surface of the second contact portion is lower than a top surface of the first contact portion.

16. The coaxial connector according to claim 1, wherein the insulating body comprises at least one stopping portion located above the second contact portion, and the stopping portion stops the second contact portion from moving upwards.

17. The coaxial connector according to claim 1, wherein the insulating body comprises a fixing portion for fixing the static terminal, a support portion is formed by extending from one side of the fixing portion, and the first contact portion is lapped on the support portion.

18. The coaxial connector according to claim 1, wherein after the mating device leaves the movable terminal, the second contact portion butts against the first contact portion upwards.

19. The coaxial connector according to claim 1, wherein the static terminal and the movable terminal both are embedded into the insulating body through an insert molding process.

* * * * *